US010460917B2

(12) United States Patent
Raman et al.

(10) Patent No.: US 10,460,917 B2
(45) Date of Patent: Oct. 29, 2019

(54) MINIATURE ION PUMP

(71) Applicant: AOSense, Inc., Sunnyvale, CA (US)

(72) Inventors: Chandra S. Raman, Sunnyvale, CA (US); Thomas H. Loftus, Los Gatos, CA (US); Mark A. Kasevich, Palo Alto, CA (US); Thang Q. Tran, San Jose, CA (US); William D. Weis, Hollister, CA (US)

(73) Assignee: AOSense, Inc., Sunnyvale, CA (US)

( * ) Notice: Subject to any disclaimer, the term of this patent is extended or adjusted under 35 U.S.C. 154(b) by 517 days.

(21) Appl. No.: 15/165,347

(22) Filed: May 26, 2016

(65) Prior Publication Data

US 2017/0345630 A1 Nov. 30, 2017

(51) Int. Cl.
*H01J 41/14* (2006.01)
*H01J 41/12* (2006.01)
*F04B 37/18* (2006.01)

(52) U.S. Cl.
CPC ..... *H01J 41/14* (2013.01); *H01J 41/12* (2013.01); *F04B 37/18* (2013.01)

(58) Field of Classification Search
CPC ..... H01J 41/14; H01J 41/12; F04B 37/14
USPC ..... 417/50
See application file for complete search history.

(56) References Cited

U.S. PATENT DOCUMENTS 2,983,433 A * 5/1961 Huffman ..... H01J 41/20 313/7
3,228,589 A * 1/1966 Kearns ..... H01J 41/20 417/49
3,428,241 A * 2/1969 Eder ..... H01J 41/12 417/49
3,540,812 A 11/1970 Henderson
3,601,503 A * 8/1971 Spouse ..... H01J 41/20 417/48
3,949,260 A * 4/1976 Bayless ..... H01J 3/025 313/157
4,594,054 A * 6/1986 Ishimaru ..... H01J 41/18 417/49
4,890,029 A * 12/1989 Miyoshi ..... H01J 37/18 313/7
6,004,104 A * 12/1999 Rutherford ..... H01J 41/14 417/49
6,264,433 B1 * 7/2001 Spagnol ..... H01J 41/12 417/48
6,989,533 B2 * 1/2006 Bellec ..... H01F 7/0278 250/291
8,512,005 B2 * 8/2013 Tanaka ..... H01J 41/20 417/48
9,960,026 B1 * 5/2018 Hughes ..... H01J 41/14
(Continued)

FOREIGN PATENT DOCUMENTS

WO WO-2014132758 9/2014

OTHER PUBLICATIONS

High Current Ion Sources at GSI Part 1, by Ralph Hollinger & Aleksey Adonin, published Feb. 1, 2016.*
(Continued)

*Primary Examiner* — Charles G Freay
*Assistant Examiner* — Thomas Fink
(74) *Attorney, Agent, or Firm* — Van Pelt, Yi & James LLP

(57) ABSTRACT

A system for ion pumping including an anode, a cathode, and a magnet. The magnet comprises a Halbach magnet array.

19 Claims, 9 Drawing Sheets

(56) References Cited

U.S. PATENT DOCUMENTS

| | | | | |
|---|---|---|---|---|
| 2002/0159891 | A1* | 10/2002 | Shen | H01J 27/08 417/50 |
| 2004/0062659 | A1* | 4/2004 | Sinha | H01J 41/12 417/50 |
| 2004/0234379 | A1 | 11/2004 | Miner | |
| 2005/0092919 | A1* | 5/2005 | Bellec | H01F 7/0278 250/290 |
| 2006/0043871 | A1 | 3/2006 | Kamio | |
| 2010/0098556 | A1* | 4/2010 | Tanaka | H01J 41/12 417/49 |
| 2010/0310383 | A1* | 12/2010 | Tanaka | F04B 37/02 417/48 |
| 2012/0262261 | A1* | 10/2012 | Sarai | H01F 7/02 335/306 |
| 2015/0240797 | A1* | 8/2015 | Tin | H01J 41/18 417/49 |
| 2015/0311048 | A1* | 10/2015 | Nelson | F04B 19/006 417/49 |
| 2016/0141160 | A1* | 5/2016 | Gardner | H01J 41/12 417/48 |
| 2016/0196963 | A1* | 7/2016 | Saparqaliyev | H01F 7/02 417/48 |
| 2016/0233062 | A1* | 8/2016 | Gardner | H01J 41/12 |

OTHER PUBLICATIONS

Miniature Sputter-Ion Pump Design Considerations, by Rutherford, published 1999.*

Joining of titanium/stainless steel by explosive welding and effect on interface, by Kahraman, published 2005.*

Sputter-Ion Pumps, by Schulz, published 1999.*

J. M. D. Coey: "Permanent magnet applications." Journal of Magnetism and Magnetic Materials 248.3 (2002): 441-456.

* cited by examiner

MINIATURE ION PUMP

This invention was made with government support under contract #HR0011-09-C-0116 awarded by Darpa. The government has certain rights in the invention.

BACKGROUND OF THE INVENTION

Ion pumps are a workhorse of ultra-high vacuum systems. With no moving parts, they are quiet and consume very little electrical power. They are also very clean, containing only metal interior surfaces that capture and trap gas within the pump body. Ion pumps can be used to provide vacuum for numerous applications, including inertial sensors such as atomic interferometer-based accelerometers, gyroscopes and gravimeters, as well as time keeping devices such as atomic clocks. Reducing the volume of these sensors is desirable in order to deploy them on moving vehicles or other dynamic platforms. Often, the ion pump size is the limiting factor for total system volume. In addition, the magnetic fringe fields produced by the pump can impact the sensor.

BRIEF DESCRIPTION OF THE DRAWINGS

Various embodiments of the invention are disclosed in the following detailed description and the accompanying drawings.

DETAILED DESCRIPTION

Figure 1:
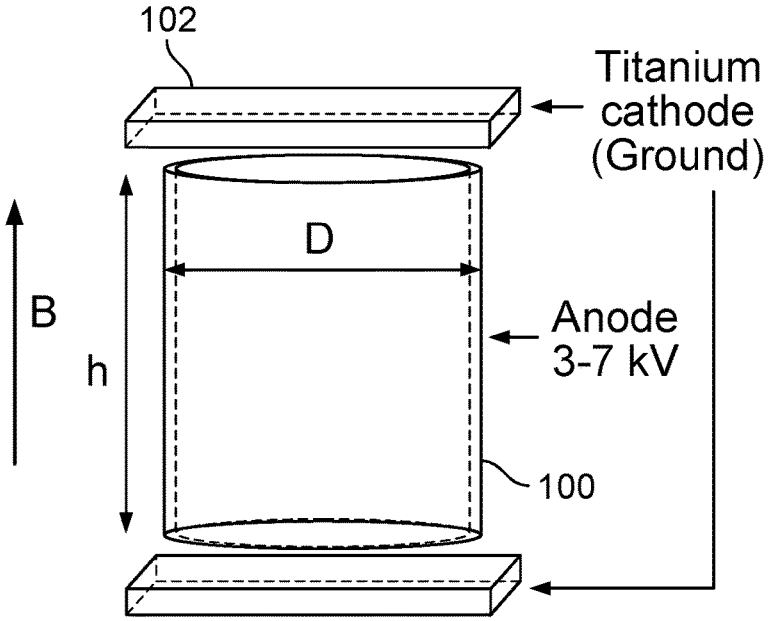
FIG. 1 is a diagram illustrating an embodiment of an ion pump.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A system for pumping is disclosed. In some embodiments, the system for pumping comprises an anode; a cathode; and a magnet, wherein the magnet comprises a Halbach magnet. In some embodiments, the system for pumping comprises an anode, a cathode, a filament, wherein the filament enters a region in the vicinity (e.g., within 1-2 millimeters) of the anode surface and the cathode surface, and a magnet.

In some embodiments, a miniature system for pumping comprises an ion pump. An ion pump comprises an anode, a cathode, and a magnet creating a magnetic field in the region between the anode surface and the cathode surface. In various embodiments, the miniature system for pumping has a diameter D of the cylinder of the anode of less than 1 cm, has a diameter D of the cylinder of the anode of less than 0.8 cm, or any other appropriate small diameter. A high voltage power supply is connected between the anode and cathode in order to establish a potential difference between them. The combination of the high voltage and magnetic field causes stray electrons to collide with molecules within the pump volume. The collisions cause the molecules to ionize. Ionized molecules are then rapidly accelerated to the cathode by the electrical field produced by the high voltage. In some embodiments, the anode is at a positive high voltage with respect to the cathode. In some embodiments, the anode is at a negative high voltage with respect to the cathode. When ionized molecules collide with the cathode, they become embedded in the cathode material and are unable to escape. The ion pump removes molecules from the pump volume in this way, gradually lowering the pressure. The miniature system for pumping comprises an ion pump designed to be placed in close proximity with other high sensitivity equipment. Therefore, minimizing the fringing fields of the magnet so as not to disturb the other equipment is a priority. In order to minimize the fringing fields, the magnet of the ion pump comprises a Halbach magnet or Halbach magnet array, which comprises an array of magnets in a configuration that reduces fringing fields. The Halbach magnet creates a magnetic field within its roughly cylindrical shape with reduced fringing fields. The miniature system for pumping comprises an anode and a cathode designed to fit within the roughly cylindrical shape of the Halbach magnet.

In some embodiments, ionization within an ion pump starts as a result of the random emission of an electron from the cathode. For an ion pump with a large surface area, a random emission occurs within a short time as the number of potential sources for the emission are large. However, for a small ion pump comprising a small cathode, the expected time for emission of an electron can be undesirably large. In some embodiments, in order to start ionization directly, the pump comprises an auxiliary electron emission source. This source may be a filament, field emitter or similar means. In the case of a filament, it enters into the vicinity (e.g., within 1-2 millimeters) of the surface of the anode and the surface of the cathode. Power is provided to the filament, causing it to heat and emit electrons, which are then able to start ionization of the pump. In some embodiments, the pump current (e.g., the current drawn from the high voltage power supply) is measured in order to determine when ionization is started and this measurement is used to turn off the power to the filament. In some embodiments, the filament is able to start ionization with enough reliability that feedback is not required, and a predetermined pulse shape of power is applied to the filament.

FIG. 1 is a diagram illustrating an embodiment of an ion pump. In the example shown, the ion pump comprises anode 100 and cathode 102. The anode has a cylindrical shape with height h and diameter D, and the cathode comprises a plate at either end of the anode cylinder. A power supply is used to raise the anode to high voltage (e.g., 3-7 kV) relative to the cathode (e.g., at ground). A magnet is used to create a magnetic field parallel to the axis of the anode cylinder.

In some embodiments, the rate at which gas is pumped (a quantity known as the pumping speed, measured in liters per second, or L/sec) is proportional to the number of electrons within the anode volume (e.g., anode volume=$\pi h D^2/4$). The pumping speed increases quadratically with the magnetic field B for large enough fields and pressures below $10^{-5}$ Torr (medium to high vacuum) operation. However, as the pump dimensions become smaller, there is a cutoff magnetic field below which the discharge cannot be sustained and the pump will not operate. This field scales inversely with the anode diameter as $B_{crit}$=600 gauss/D, where D is in centimeters. From this formula it is clear that reducing the physical dimensions of an ion pump necessarily requires an increase in the operating magnetic field in order to avoid cutoff. For example, the pumping speed of a D=h=1 cm anode volume is about 0.4 L/sec at a field of 2000 Gauss, while its cutoff field is 600 Gauss. Commercial ion pumps with pumping speeds in the few L/sec range utilize multiple cells with D=1 cm or larger, which represents a practical lower limit on the cell size for traditional dipole magnet designs.

Figure 2A:
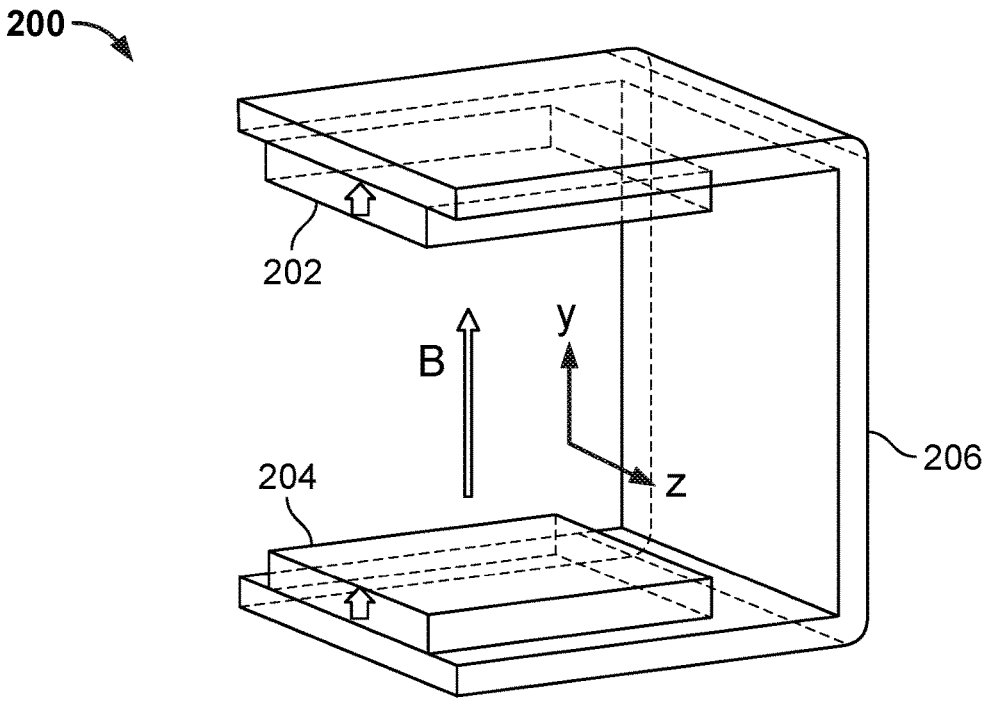
FIG. 2A is a diagram illustrating an embodiment of a dipole magnet.

FIG. 2A is a diagram illustrating an embodiment of a dipole magnet. In some embodiments, dipole magnet 200 is used to create the magnetic field of the ion pump of FIG. 1. In the example shown, dipole magnet 200 comprises a pair of magnetic plates placed parallel to one another—for example, plate 202 above and plate 204 below the cathode plates of an ion pump with a soft-iron yoke 206 serving to return the magnetic flux. In some embodiments, dipole magnet 200 has high fringing fields.

Figure 2B:
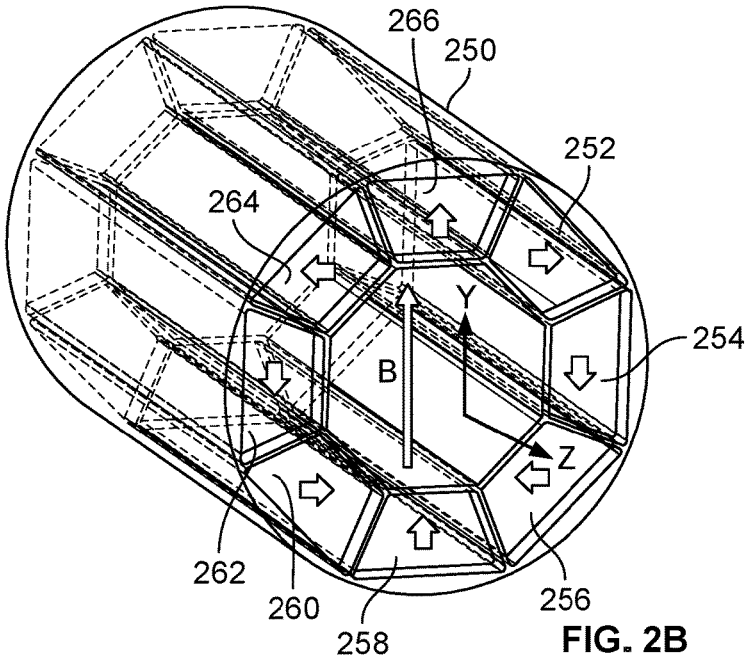
FIG. 2B is a diagram illustrating an embodiment of a Halbach magnet.

FIG. 2B is a diagram illustrating an embodiment of a Halbach magnet array. In some embodiments, Halbach magnet array 250 is used to create the magnetic field of the ion pump of FIG. 1. In the example shown, Halbach magnet array 250 comprises eight magnetic regions (e.g., magnet 252, magnet 254, magnet 256, magnet 258, magnet 260, magnet 262, magnet 264, and magnet 266), each the shape of an extruded trapezoid. The eight regions are arranged around a central axis to form the shape of an extruded octagon with a central cavity the shape of a smaller extruded octagon. In various embodiments, the eight magnets taken together comprise a different shape such as an extruded annulus, a different numbers of magnets are used, or any other appropriate variation of magnet configurations. In some embodiments, the ion pump is placed within the central cavity of Halbach magnet array 250. In some embodiments, Halbach magnet array 250 has reduced fringing fields (e.g., as compared with dipole magnet 200).

Figure 3:
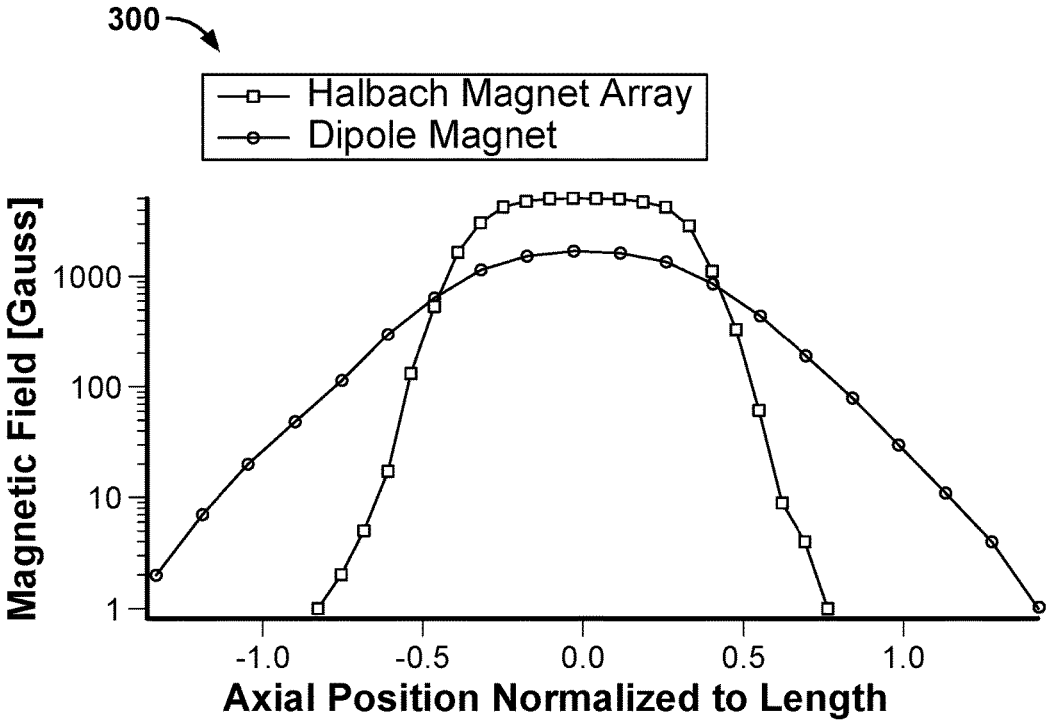
FIG. 3 is a diagram illustrating an embodiment of magnetic field measurement data.

FIG. 3 is a diagram illustrating an embodiment of magnetic field measurement data. In some embodiments, graph 300 comprises magnetic field data taken from a dipole magnet (e.g., dipole magnet 200 of FIG. 2A) and from a Halbach magnet (e.g., Halbach magnet 250 of FIG. 2B). In the example shown, both magnets are of length 1 (e.g., they extend from −0.5 to 0.5 in the graph). It is observed that outside the magnet (e.g., below −0.5 or above 0.5) the magnetic field strength drops off faster for the Halbach magnet than the dipole magnet, while within the magnet (e.g., above −0.5 and below 0.5) the magnetic field strength is higher for the Halbach magnet.

In some embodiments, an ion pump with a Halbach magnet and 4 anode cylindrical volumes (Penning cells), each of which has D=0.5 cm achieves 1 L/sec pumping speed in a package volume of only 30 $cm^3$ including auxiliary magnetic shields. By comparison, a conventional pump using D=1 cm or larger has a speed of only 0.2 L/sec, and its package volume excluding magnetic shields is greater than 40 $cm^3$.

Figure 4:
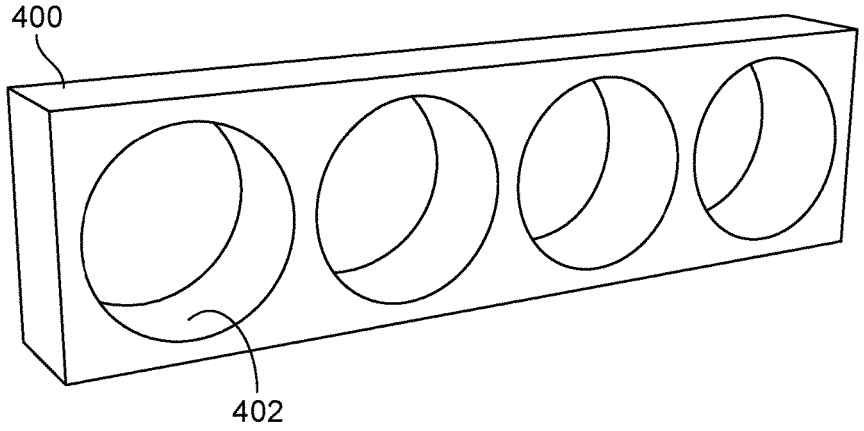
FIG. 4 is a diagram illustrating an embodiment of an anode.

FIG. 4 is a diagram illustrating an embodiment of an anode. In some embodiments, anode 400 comprises anode 100 of FIG. 1. In some embodiments, anode 400 comprises a plurality of anode chambers (e.g., anode chamber 402). In some embodiments, the anode chambers are cylindrical. In the example shown, anode 400 comprises 4 anode chambers. In various embodiments, anode 400 comprises 1, 2, 3, 4, 5, 6, 7, 8, 9, 10, 11, 22, 48, or any other appropriate number of anode chambers. In various embodiments, anode 400 is formed from titanium, stainless steel, tungsten, aluminum, molybdenum, or any other appropriate material. In some embodiments, the cylinders are 5 mm in diameter and 5 mm in depth and there is a 0.5 mm gap between cylinders.

Figure 5:
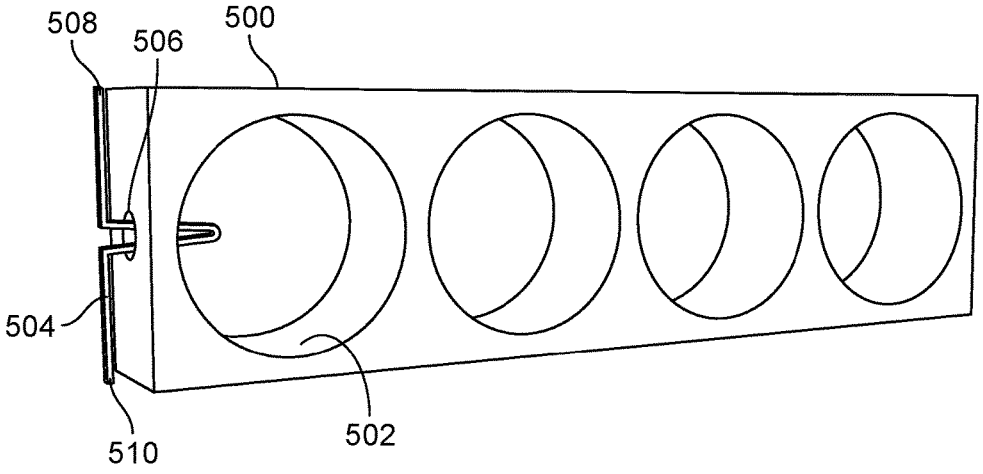
FIG. 5 is a diagram illustrating an embodiment of an anode comprising a filament.

FIG. 5 is a diagram illustrating an embodiment of an anode comprising a filament. In the example shown, anode 500 comprises anode chamber 502 and filament 504. Filament 504 extends from outside anode 500, through hole 506, and into anode chamber 502. In some embodiments, filament 504 comprises a filament for starting an ion pump. In some embodiments, applying power to filament 504 (e.g., by connecting a power supply to filament end 508 and filament end 510) causes filament 504 to emit electrons. This starts the ionization of the ion pump. In some embodiments, the cylinders of the anode are 5 mm diameter each, and the filament is approximately 3.5 mm from the base to the tip. The detailed shape of the filament is not critical, but the shown shape works well. There is a ceramic insulator between the filament electrodes and the cathode. There is only a vacuum gap between filament and anode, but the anode is separately insulated from the cathode via a ceramic standoff.

Figure 6:
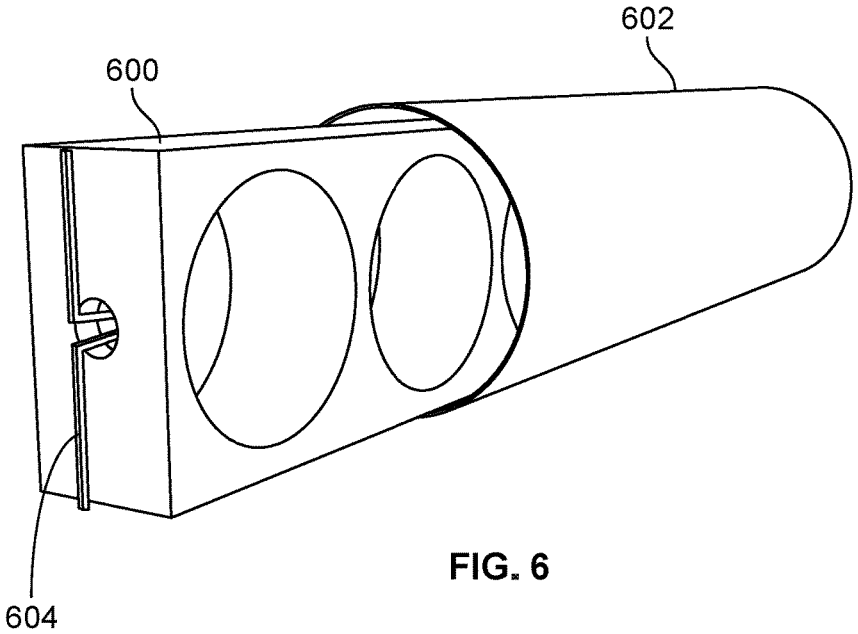
FIG. 6 is a diagram illustrating an embodiment of an anode and a cathode.

FIG. 6 is a diagram illustrating an embodiment of an anode and a cathode. In the example shown, anode 600 comprises filament 604. Anode 600 is partially inserted into cathode 602. In some embodiments, cathode 602 comprises cathode 102 of FIG. 1. In some embodiments, anode 600 slides into cathode 602. In the example shown, cathode 602 comprises a cylinder. In various embodiments, cathode 602 is formed from titanium, tantalum, or other reactive material. In some embodiments, the anode is insulated from the cathode via a ceramic standoff. In some embodiments, the cathode inner diameter (ID) is 7.5 mm and its length is 38.5 mm.

Figure 7:
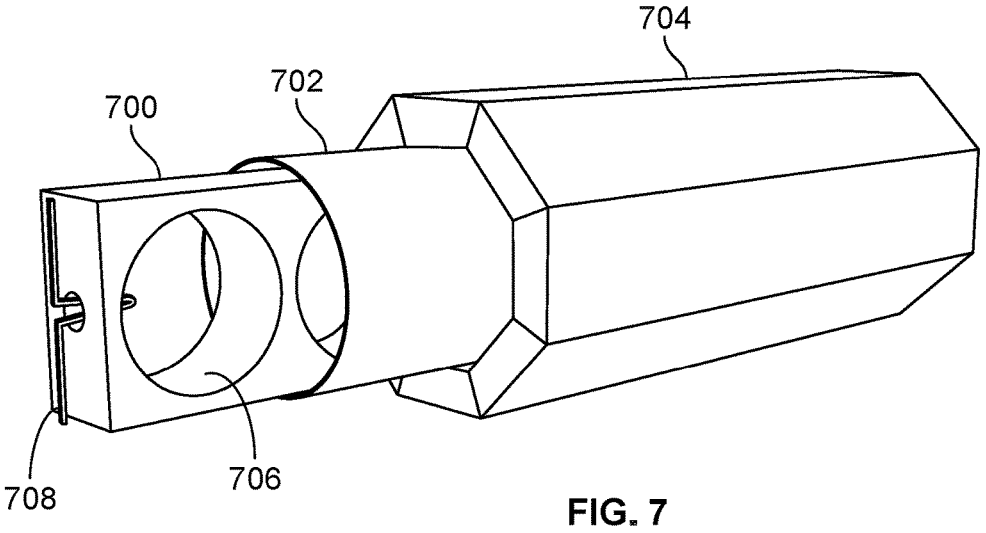
FIG. 7 is a diagram illustrating an embodiment of an anode, a cathode, and a Halbach magnet.

FIG. 7 is a diagram illustrating an embodiment of an anode, a cathode, and a Halbach magnet. In the example shown, anode 700 comprises filament 708. Anode 700 is partially inserted into cathode 702 and cathode 702 is partially inserted into Halbach magnet 704. In some embodiments, cathode 702 slides into Halbach magnet 704. In the example shown, anode 700 comprises a plurality of cylindrical anode chambers (e.g., anode chamber 706). In some embodiments, Halbach magnet 704 is oriented such that the magnetic field within its central cavity is oriented parallel or substantially parallel (e.g., within 5 degree) to the central axis of the anode chambers. In some embodiments, index markings are used to align Halbach magnet 704 with cathode 702. In some embodiments index markings are used to align cathode 702 with anode 700 using the vacuum outer housing as a guide. In some embodiments, anode 700 slides into cathode 702 in a fixed orientation (e.g., there is only one way to fit anode 700 into cathode 702, due to a groove, a flange, etc.). In some embodiments, the orientation of cathode 702 within Halbach magnet 704 is adjustable (e.g., to allow the orientation to be manually tuned). In some embodiments, the orientation of cathode 702 within Halbach magnet 704 is lockable (e.g., to fix the orientation once it is tuned to the correct orientation). In some embodiments, the orientation of cathode 702 is lockable using a set screw to fix the orientation.

Figure 8:
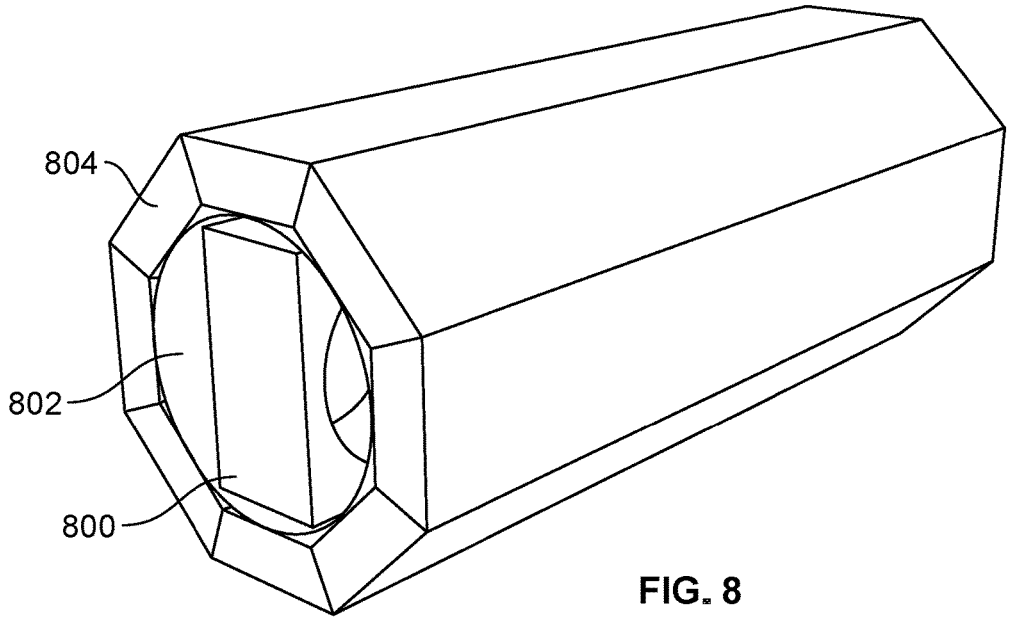
FIG. 8 is a diagram illustrating an embodiment of an ion pump assembly.

FIG. 8 is a diagram illustrating an embodiment of an ion pump assembly. In the example shown, anode 800 is inserted into cathode 802 and cathode 802 is inserted into Halbach magnet 804. In some embodiments, cathode 802 is cylindrical. In some embodiments, cathode 802 shape avoids sharp corners that can break down the high voltage difference between cathode 802 and anode 800.

Figure 9:
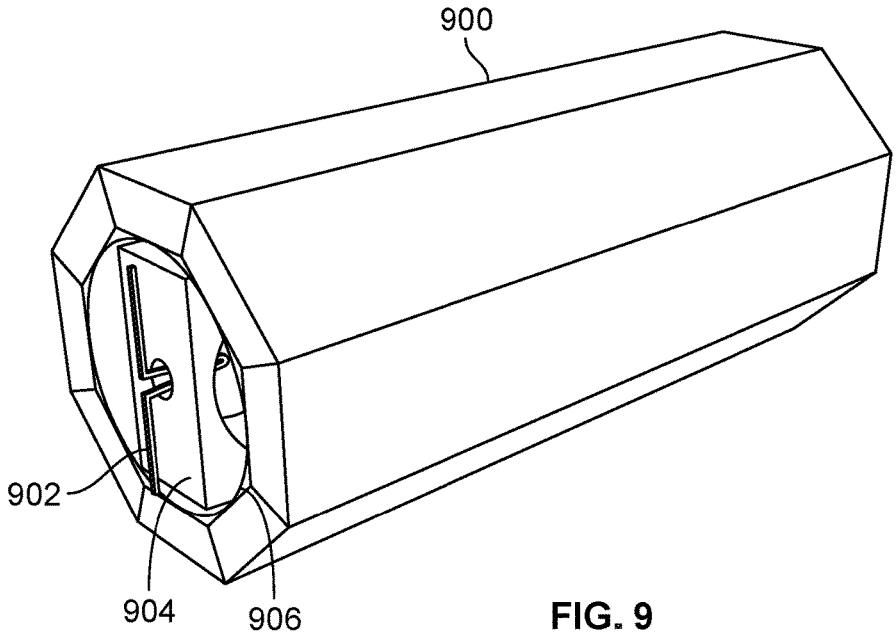
FIG. 9 is a diagram illustrating an embodiment of an ion pump assembly comprising a filament.

FIG. 9 is a diagram illustrating an embodiment of an ion pump assembly comprising a filament. In the example shown, ion pump assembly 900 comprises the ion pump assembly of FIG. 8. Ion pump assembly 900 additionally comprises filament 902. In some embodiments, filament 902 enters a region between or in the vicinity (e.g., within 1-2 millimeters) of the surface of anode 904 and cathode 906.

Figure 10:
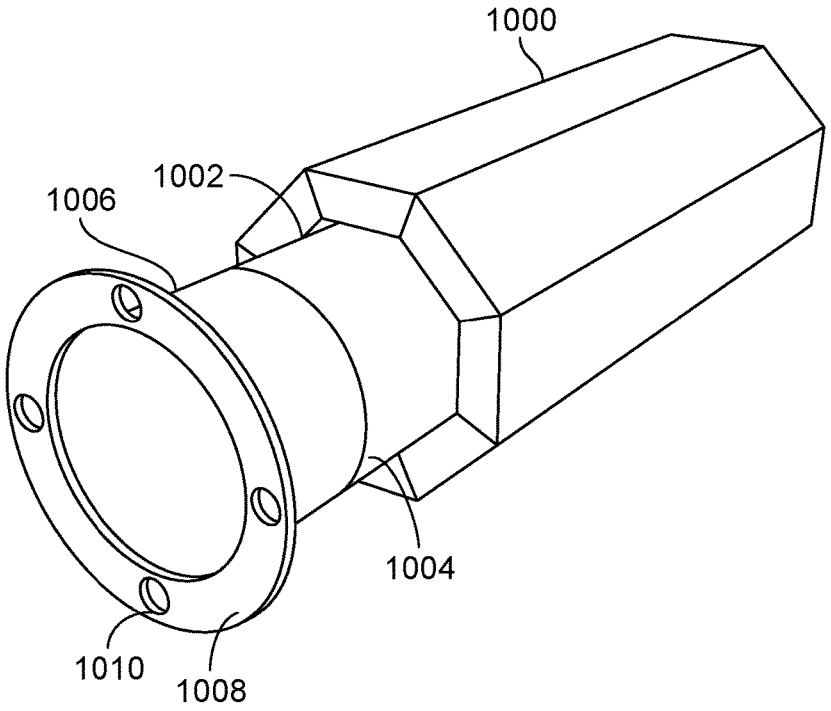
FIG. 10 is a diagram illustrating an embodiment of an ion pump assembly comprising a cathode including a connection region.

FIG. 10 is a diagram illustrating an embodiment of an ion pump assembly comprising a cathode including a connection region. In some embodiments, ion pump assembly 1000 comprises ion pump assembly 900 of FIG. 9. In the example shown, a cathode extends out from a Halbach magnet, including cathode pump region 1002 and cathode connection region 1006. Cathode pump region 1002 and cathode connection region 1006 are separated by transition 1004. In some embodiments, cathode pump region 1002 and cathode connection region 1006 are made from different materials. In some embodiments, cathode pump region 1002 is made from titanium and cathode connection region 1006 is made from stainless steel. In some embodiments, the dissimilar materials are joined by explosive bonding. In some embodiments, the dissimilar materials are joined using brazing. In the example shown, cathode connection region 1006 comprises mounting flange 1008, including a set of mounting holes (e.g., mounting hole 1010). In some embodiments, mounting holes are used to bolt the ion pump assembly to other equipment (e.g., a vacuum chamber, a sensor, etc.).

Figure 11:
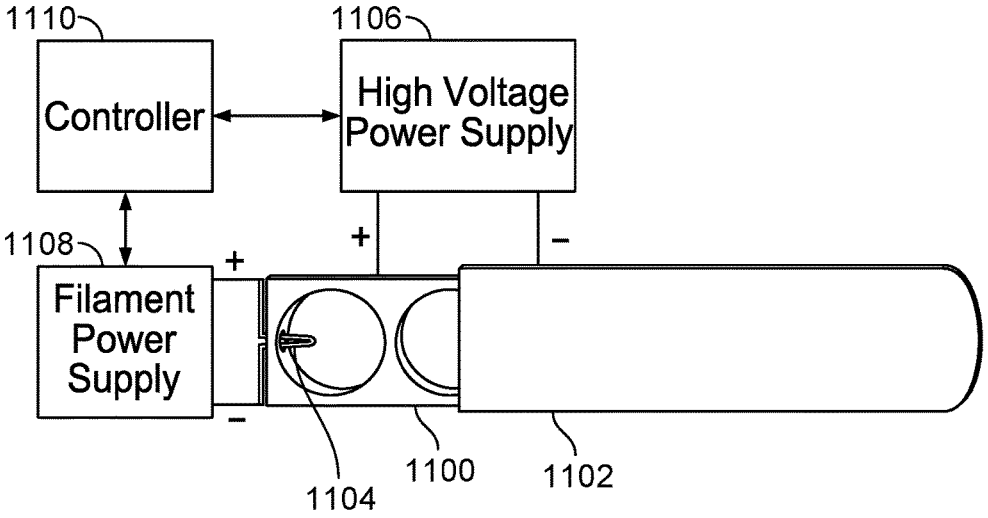
FIG. 11 is a block diagram illustrating an embodiment of ion pump power supply connections.

FIG. 11 is a block diagram illustrating an embodiment of ion pump power supply connections. In the example shown, an ion pump comprises anode 1100, cathode 1102 and filament 1104. High voltage power supply 1106 comprises a high voltage power supply for powering the ion pump. The positive terminal of high voltage power supply 1006 is connected to anode 1100 and the negative terminal of high voltage power supply 1006 is connected to cathode 1102. Filament power supply 1108 comprises a filament power supply for heating filament 1104. The positive and negative terminals of filament power supply 1108 are connected to opposite ends of filament 1104. Controller 1110 comprises a controller for providing control information to and receiving measurements from high voltage power supply 1106 and filament 1108. In various embodiments, control information comprises an on/off signal, a voltage setting, a current limit, or any other appropriate control information. In various embodiments, measurements comprise voltage measurements, current measurements, or any other appropriate measurements. In some embodiments, controller 1110 provides an indication to high voltage power supply 1106 to turn on to high voltage and an indication to filament power supply 1108 to turn on to an appropriate filament voltage (e.g., 1 V, 3 V, 10 V, etc.). When controller 1110 measures current drawn from high voltage power supply 1106 above a threshold current (e.g., indicating that the pump has started), controller 1110 provides an indication to filament power supply 1108 to turn off. In some embodiments, controller 1110 provides an indication to high voltage power supply 1106 to turn on to high voltage and an indication to filament power supply 1108 to pulse according to a predetermined pulse shape (e.g., the voltage turns on for a predetermined period of time and then turns off; the voltage ramps up at a predetermined rate, stays on for a predetermined period of time, and then ramps down at a predetermined rate, etc.).

Figure 12:
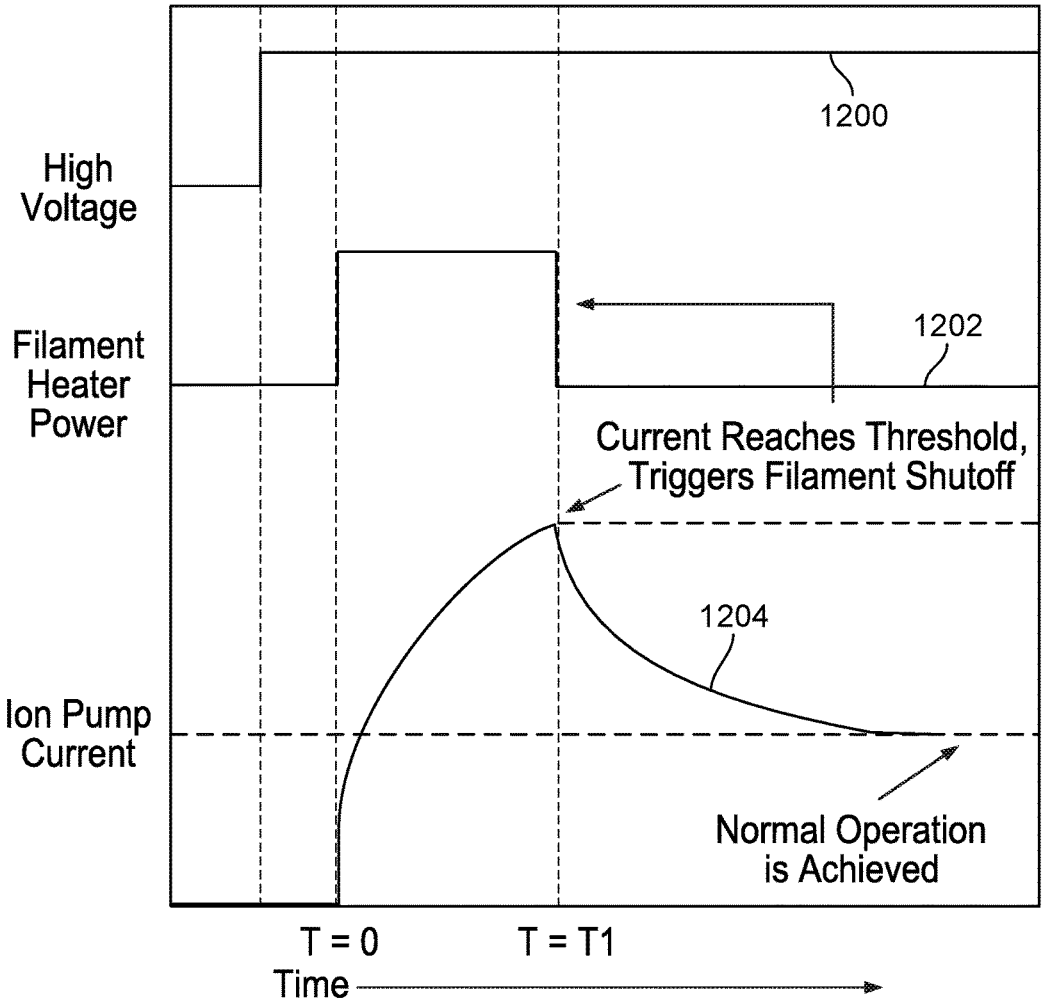
FIG. 12 is a diagram illustrating an embodiment of a startup process for an ion pump.

FIG. 12 is a diagram illustrating an embodiment of a startup process for an ion pump. In some embodiments, the diagram of FIG. 12 comprises a set of voltage and current measurements for the ion pump power supply connections shown in FIG. 11. In the example shown, high voltage measurement 1200 comprises an indication of the high voltage output of a high voltage power supply (e.g., high voltage power supply 1106 of FIG. 11). Filament heater power measurement 1202 comprises an indication of the voltage output of a filament power supply (e.g., filament power supply 1108 of FIG. 11). Ion pump current measurement 1204 comprises an indication of the current drawn by the ion pump (e.g., from the high voltage power supply). In the example shown, the high voltage is turned on first. In some embodiments, the high voltage is typically set in the range of 3-7 kV. Because of the small size of the pump, the ion pump current does not begin to rise. At time T=0, the filament heater power is turned on, immediately causing current to flow in the ion pump as a result of thermionic emission from the filament. In some embodiments, the heater voltage is typically set in the range of 1-5 V. In the example shown, the current rises in the shape of a decaying exponential, until a threshold current is reached at time T=T1. In some embodiments, a typical value of the threshold current is 100 microamps. In some embodiments, the threshold current comprises a predetermined threshold current. When the threshold current is reached, the ion pump is determined to be properly started up, and the filament heater power is shut off. The current then falls in the shape of a decaying exponential, until the steady-state operational current of the ion pump is reached. In some embodiments, a typical value of the steady-state operational current of the ion pump is 1 microAmp.

Figure 13:
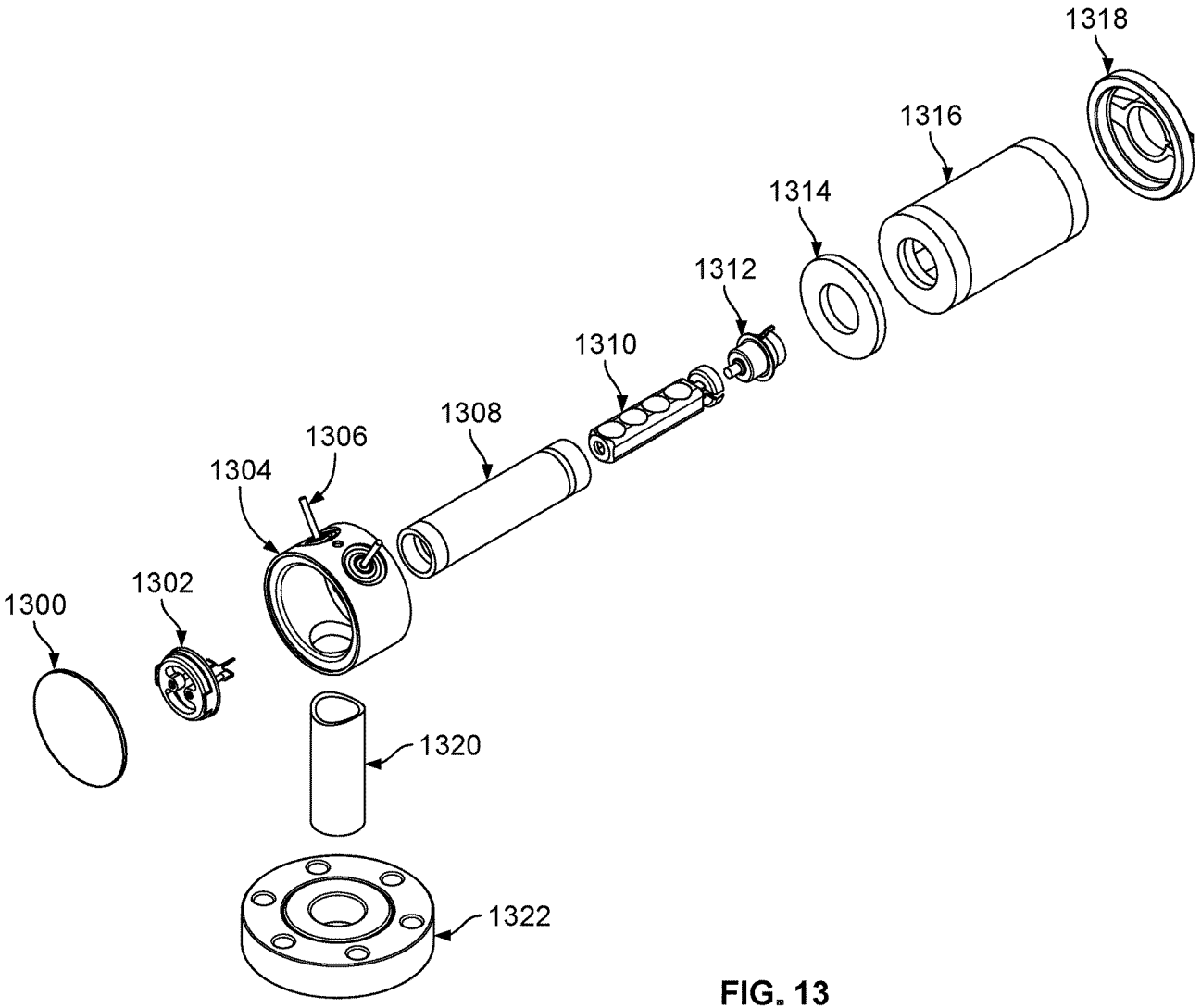
FIG. 13 is a diagram illustrating an embodiment of a miniature ion pump assembly.

FIG. 13 is a diagram illustrating an embodiment of a miniature ion pump assembly. In some embodiments, the diagram of FIG. 13 comprises an exploded view of a miniature ion pump assembly. In the example shown, weld cap 1300 comprises a weld cap for sealing the ion pump assembly by sealing the end opening of ion pump housing 1304. Brazed filament assembly 1302 comprises a filament assembly for starting the pump by thermionic emission. Ion pump housing 1304 comprises a housing for containing the pump assembly. Electrical feedthrough 1306 comprises a feedthrough for providing electrical contact to the filament. Titanium/stainless steel bimetal tube assembly 1308 comprises a tube assembly for providing a titanium cathode and a stainless steel mounting connection. In some embodiments, titanium/stainless steel bimetal tube assembly 1308 is fabricated using explosive bonding. Penning cell 1310 comprises an ion pump anode. High voltage connector 1312 comprises a high voltage connector for connecting Penning cell 1310 to a high voltage power supply. Magnet spacer 1314 comprises a magnet spacer for positioning a magnet relative to Penning cell 1310. Hallbach magnet 1316 comprises a Hallbach magnet for providing a magnetic field within the ion pump. Magnet clamp 1318 comprises a clamp for holding Hallbach magnet 1316. Pump port tube 1320 comprises a pump port tube for connecting the atmosphere of the ion pump to a piece of vacuum equipment. Pump conflat flange 1322 comprises a conflat flange for sealing the pump to a piece of vacuum equipment. Ion pump housing 1304 is attached to Halbach magnet 1316 by being pressed in place and held using magnetic clamp 1318. In some embodiments, from ion pump housing 1304 to magnetic clamp 1318 measures 50 mm. In some embodiments, electrical feedthrough 1306 connects to the filament only. In some embodiments, high voltage connector 1312 connects to both the anode and the cathode, and seals the pump. Magnetic spacer 1314, Halbach magnet 1316, and magnet clamp 1318 are outside the vacuum.

Figure 14:
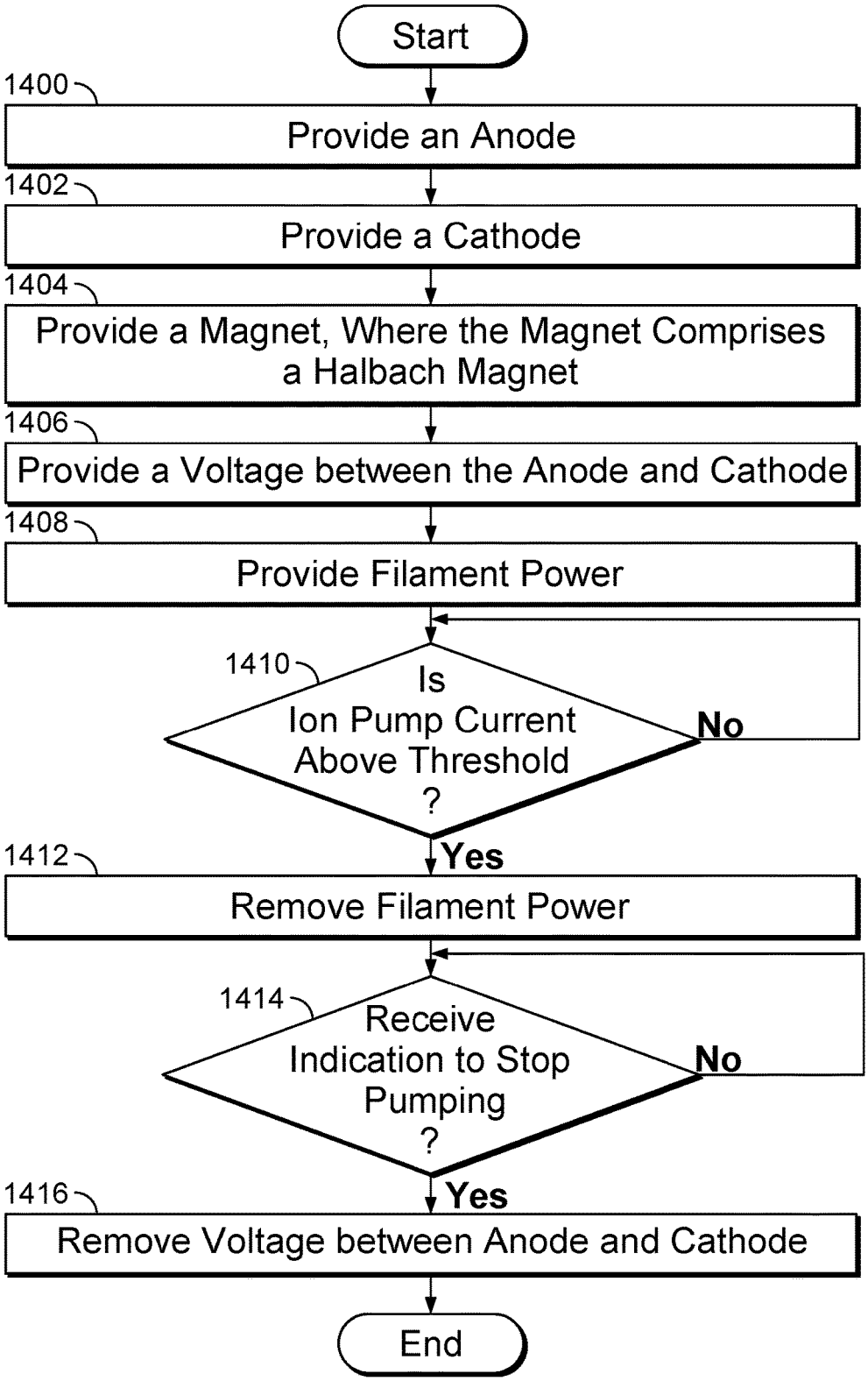
FIG. 14 is a flow diagram illustrating an embodiment of a process for ion pumping.

FIG. 14 is a flow diagram illustrating an embodiment of a process for ion pumping. In some embodiments, the process of FIG. 14 is used to operate the ion pump of FIG. 11. In the example shown, in 1400 an anode is provided. In 1402, a cathode is provided. In 1404, a magnet is provided, wherein the magnet comprises a Halbach magnet. In 1406, a voltage is provided between the anode and cathode. For example, a voltage between 3-7 kV is provided between the anode and cathode. In various embodiments, a hardware device and/or a computer program switches or indicates to switch on a voltage that is provided to the anode and cathode. In some embodiments, 1406 is not performed unless an indication is received to start ion pumping. In 1408, power is provided to the filament. For example, the filament is provided power to start the ion current in the pump because the anode and/or cathode are small in surface area leading to a longer time for spontaneous starting of the pump. In various embodiments, a hardware device and/or a computer program switches or indicates to switch on power that is provided to the filament. In 1410, it is determined whether the ion pump current is above a threshold. For example, the ion pump current is measured and it is determined whether the current is above a predetermined threshold (e.g., 100 microamps). In various embodiments, a hardware device and/or a computer program receives data regarding ion pump current—for example, a digital conversion of a signal that measures the ion pump current is received and the value associated with the digitized conversion of the signal is compared to a threshold value. In the event that the ion current is not above the threshold control passes to 1410. In the event that the ion current is above the threshold, in 1412 the filament power is removed. In 1414, it is determined whether an indication to stop pumping is received. In the event that an indication to stop pumping is not received, control passes to 1414. In the event that an indication to stop pumping is received, then in 1416 the voltage between the anode and the cathode is removed and the process ends. In various embodiments, a hardware device and/or a computer program switches or indicates to switch off power that is provided to the anode and cathode. In some embodiments, filament power is provided in the event that the pump current is not above threshold. In some embodiments, in the event that voltage is provided and current flows, the filament is not needed.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A system for ion pumping, comprising:

an anode, wherein the anode comprises one or more cylindrical anode chambers, wherein at least one cylindrical anode chamber of the one or more cylindrical anode chambers has a central axis;

a cathode, wherein the cathode surrounds the anode, and wherein the central axis of the at least one cylindrical anode chamber of the one or more anode chambers is orthogonal to a longitudinal axis of a length of the cathode; and a magnet, wherein the magnet comprises a Halbach magnet that surrounds the cathode, and wherein the longitudinal axis of the length of the cathode is coaxial with a longitudinal axis of a length of the magnet.

2. The system of claim 1, wherein a magnetic field of the Halbach magnet passes through the anode substantially parallel to the central axis of the cylinder of the anode chamber.

3. The system of claim 1, wherein the cathode comprises a cylindrical tube.

4. The system of claim 1, wherein the anode fits into the cathode.

5. The system of claim 1, wherein the cathode fits into the magnet.

6. The system of claim 5, wherein an orientation of the cathode within the magnet is adjustable.

7. The system of claim 6, wherein the orientation of the cathode within the magnet is lockable.

8. The system of claim 1, wherein the cathode is formed from two metals.

9. The system of claim 8, wherein the cathode comprises titanium in a pump region and stainless steel in a connection region.

10. The system of claim 8, wherein the two metals are dissimilar and joined by explosive bonding.

11. The system of claim 1, further comprising a high voltage power source, wherein the cathode is connected to the negative terminal of the high voltage power source.

12. The system of claim 11, wherein the anode is connected to the positive terminal of the high voltage power source.

13. A miniature system for ion pumping, comprising:

an anode, wherein the anode comprises one or more cylindrical anode chambers, wherein at least one cylindrical anode chamber of the one or more cylindrical anode chambers has a central axis;

a cathode, wherein the cathode surrounds the anode, and wherein the central axis of the at least one cylindrical anode chamber of the one or more anode chambers is orthogonal to a longitudinal axis of a length of the cathode;

a filament, wherein the filament enters a region is in a vicinity (within 1-2 millimeters) of an anode surface and a cathode surface; and a magnet, wherein the magnet comprises a Halbach magnet that surrounds the cathode, and wherein the longitudinal axis of the length of the cathode is coaxial with a longitudinal axis of a length of the magnet.

14. The system of claim 13, wherein the filament protrudes into one of the one or more anode chambers.

15. The system of claim 13, wherein electric current is provided to the filament in order to start ionization.

16. The system of claim 15, further comprising a high voltage power source connecting the anode and the cathode, wherein electric current drawn from the high voltage power source is measured.

17. The system of claim 16, wherein a measured current is used to determine when to turn off the current to the filament.

18. The system of claim 15, wherein the electric current to the filament is pulsed according to a predetermined pulse shape.

19. A method for pumping ions comprising:

providing an anode, wherein the anode comprises one or more cylindrical anode chambers, wherein at least one cylindrical anode chamber of the one or more cylindrical anode chambers has a central axis;

providing a cathode, wherein the cathode surrounds the anode, and wherein the central axis of the at least one cylindrical anode chamber of the one or more anode chambers is orthogonal to a longitudinal axis of a length of the cathode;

providing a magnet, wherein the magnet comprises a Halbach magnet that surrounds the cathode, and wherein the longitudinal axis of the length of the cathode is coaxial with a longitudinal axis of a length of the magnet;

providing a voltage between the anode and the cathode;

determining whether an ion pump current is above a threshold;

in the event that the ion pump current is below the threshold, providing a filament power;

in the event that the ion pump current is above the threshold, remove the filament power;

determine whether an indication is received to stop pumping; and in the event that an indication is received to stop pumping, the voltage between the anode and the cathode is removed.

* * * * *